United States Patent [19]

Van Vliet et al.

[11] 4,117,371

[45] Sep. 26, 1978

[54] ELECTRIC DEVICE PROVIDED WITH A METAL VAPOR DISCHARGE LAMP

[75] Inventors: Johannes Adrianus Josephus Maria Van Vliet; Pieter Hendrik Broerse, both of Eindhoven, Netherlands

[73] Assignee: U.S. Philips Corporation, New York, N.Y.

[21] Appl. No.: 757,676

[22] Filed: Jan. 7, 1977

[30] Foreign Application Priority Data

Jan. 19, 1976 [NL] Netherlands ..... 7600480

[51] Int. Cl.[2] ..... H01J 7/44; H01J 13/46; H01J 19/78; H01K 1/62

[52] U.S. Cl. ..... 315/46; 315/53; 315/58; 315/60; 315/71; 315/264

[58] Field of Search ..... 315/59, 46, 58, 60, 315/71, 47, 53, 61, 62, 67, 261, 264, DIG. 1

[56] References Cited

U.S. PATENT DOCUMENTS

| | | | |
|---|---|---|---|
| 2,247,198 | 6/1941 | Krefft et al. | 315/60 |
| 2,286,789 | 6/1942 | Dench | 315/59 |
| 3,093,769 | 6/1963 | Kuhl et al. | 315/46 |

FOREIGN PATENT DOCUMENTS

| | | | |
|---|---|---|---|
| 877,661 | 9/1942 | France | 315/46 |

*Primary Examiner*—Saxfield Chatmon, Jr.
*Attorney, Agent, or Firm*—Frank R. Trifari; Robert S. Smith

[57] ABSTRACT

A metal vapor discharge lamp includes a discharge tube with main electrodes at each end. A starting electrode extends around at least an axial portion of the tube intermediate the main electrodes, one main electrode is connected to the starting electrode by a first resistance and the other main electrode is connected to the other electrode by a second resistance. At least one of the resistances has a temperature dependent characteristic which is substantially more positive than the other resistance.

6 Claims, 1 Drawing Figure

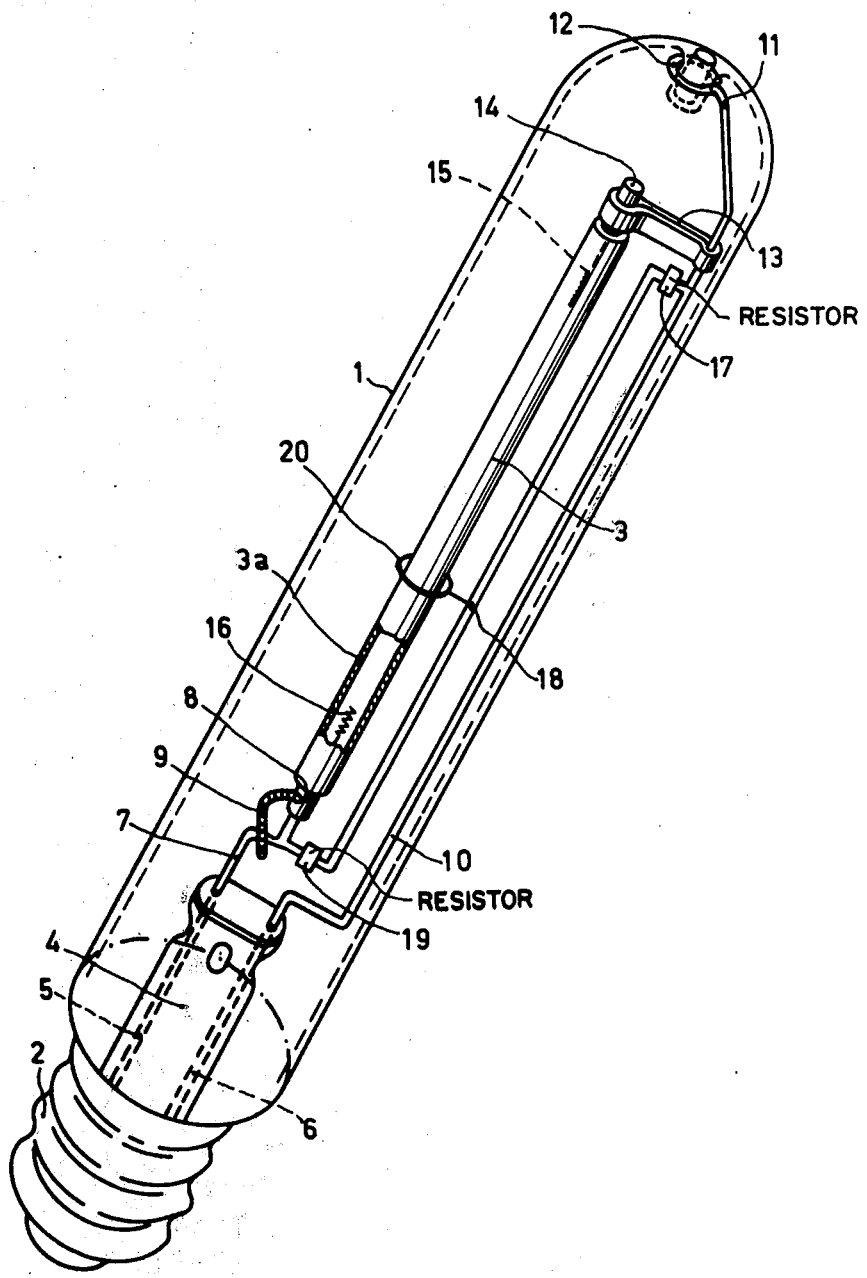
12
11
14
15
13
RESISTOR
17
1
20
3
3a
16
18
8
9
7
10
RESISTOR
19
4
5
2
6

ELECTRIC DEVICE PROVIDED WITH A METAL VAPOR DISCHARGE LAMP

The invention relates to an electric device provided with a metal vapour discharge lamp having a discharge tube, the discharge tube being provided with two internal main electrodes and with an external starting-auxiliary electrode, the auxiliary electrode being located opposite an internal portion of the discharge tube which is disposed between the main electrodes, and the external auxiliary electrode being connected to a tap of a variable voltage divider which is provided with a temperature-dependent resistor.

Such a device is, for example, used for lighting purposes.

A known device of the said type is, for example, described in Austrian Pat. No. 290,672. A disadvantage of that known device is that in the operating condition of the lamp there is a difference in potential between the auxiliary electrode and the internal portion of the discharge tube situated opposite that auxiliary electrode. Such a difference in potential may cause the wall of the discharge tube to be attached by ions of the metal which participates in the discharge.

Another known device which is, for example, described in U.K. Pat. No. 1,340,551, however, is not provided with a variable voltage divider — it has been found that near a curl-shaped auxiliary electrode which has, during operation of the lamp, a difference in potential with respect to the internal portion of the discharge tube situated opposite that auxiliary electrode, black dots may be produced on that tube. These dots are caused by the fact that ions, in the present case sodium ions in particular, are captured by the inner side of the discharge tube wall. Apparently this capturing is promoted by an increased number of ion-wall collisions owing to the said difference in potential.

Inter alia with the last-mentioned known device it has been proposed to switch the auxiliary electrode off by means of a bi-metal switch, after starting of the lamp. This indeed reduces the risk of black dots being produced. However, the complication of the bi-metal switch with its moving part, which must react to the generation of heat in the discharge tube, is disadvantageous.

It is an object of the invention to reduce, with device of the type mentioned in the preamble, the risk of attack of the discharge tube wall without utilizing an auxiliary element having a moving part.

According to the invention there is provided an electric device provided with a metal vapour discharge lamp having a discharge tube, the discharge tube being provided with two internal main electrodes and with an external starting-auxiliary electrode, the auxiliary electrode being situated opposite an internal portion of the discharge tube which is disposed between the main electrodes, and the external auxiliary electrode being connected to the tapping point of a voltage divider which includes a temperature-dependent resistor, wherein the dimension of the auxiliary electrode measured in a direction parallel to the longitudinal axis of the discharge tube is not more than 10% of the main electrode spacing, wherein the entire voltage divider shunts the discharge path between the main electrodes, and wherein the voltage division in the operating condition of the lamp has such a value that the difference in potential between the auxiliary electrode and the said internal portion of the discharge tube is not more than 20% of the arc voltage of the lamp.

An advantage of an arrangement according to the invention is that in the operating condition of the lamp the difference in potential between the auxiliary electrode and the internal portion of the discharge tube situated opposite that auxiliary electrode is relatively small so that the risk of attack of the discharge tube wall in that place is small.

A resistor of the voltage divider may, for example, be a resistor having a negative temperature coefficient (N.T.C. resistor) whilst the other resistor may be a fixed resistor. A resistor of the voltage divider may alternatively be a resistor having a positive temperature coefficient (P.T.C. resistor). A combination of these two types of temperature-dependent resistors is also conceivable. A part of the voltage divider may, for example, consist of two or more parallel-connected resistors, for example of a fixed resistor which is shunted by a P.T.C. resistor.

The auxiliary electrode might, for example, be disposed approximately midway between the main electrodes of the lamp.

In a preferred embodiment of an arrangement according to the invention, the distances from the auxiliary electrode to the two main electrodes of the discharge tube are unequal and the part of the variable voltage divider which is disposed between the auxiliary electrode and the remoter main electrode comprises a resistor having a positive temperature coefficient. An advantage of this preferred embodiment is that then a low starting voltage of the discharge tube is combined with a situation in which the chance of attack of the discharge tube wall by ions is small.

In a further preferred embodiment of an arrangement according to the invention, the lamp is a high-pressure sodium vapour discharge lamp and the discharge tube wall mainly consists of aluminium oxide. An advantage of this preferred embodiment is that the good light-technical properties of this type of lamp are not reduced by an attack of the tube wall due to the auxiliary electrode potential.

The last preferred embodiment may still be further improved by arranging the voltage divider in the space between the discharge tube and an outer bulb which envelopes this tube. An advantage of this improved construction is that the number of electric feedthroughs through the wall of the outer bulb may be relative low.

As a rule the total resistance of the voltage divider in the operating condition of the lamp will be chosen to be considerably higher than the lamp resistance in the operating condition in order to limit losses in that voltage divider.

The temperature-sensitive resistors(s) of the voltage divider may be raised to and kept at a suitable temperature, for example, mainly by the generation of heat of the discharge tube or mainly by the current through this (these) resistors.

An embodiment of the invention will now be described by way of example with reference to the accompanying drawing which shows a device according to the invention.

In this drawing reference 1 indicates a glass outer bulb of a high-pressure sodium vapour discharge lamp. It relates here to a lamp of approximately 400 Watts having a length of approximately 27% cm. Reference 2 indicates a lamp base. Reference 3 represents a discharge tube in the outer bulb 1. The wall of the tube 3 consists mainly of polycrystalline aluminium oxide. A part of the discharge tube 3, namely the part 3*a*, is shown in a longitudinal section. Reference 4 indicates a stem comprosing two electrical supply conductors 5 and 6. Conductor 5 is electrically connected to a conductor 7 whose other side extends into a tubular current supply element 8 which is disposed at an end of the discharge tube 3. Connected to the conductor 7 there is a litz wire 9 which is in electrical contact with the outer circumference of the current supply element 8. The supply conductor 6 is connected to a pole wire which consists of a straight section 10 and a section 11 which is provided with a loop 12 which is wrapped around an indentation in an end portion of the outer bulb 1. A rigid current supply foil 13 which is electrically connected to a tubular current supply element 14 of the discharge tube 3 is fitted to an end of the straight portion of the pole wire 10. The current supply element 14 is connected to a main electrode 15 of the tube 3. The current supply element 8 is connected to a main electrode 16 of the tube 3. Furthermore the main electrode path 15–16 is shunted by a variable voltage divider 17, 18, 19; mainly via the current supply foil 13. Of that voltage divider reference 17 is a resistor having a positive temperature coefficient, 18 is a tapping point of that voltage divider and 19 is a fixed resistor. An external auxiliary or starting electrode 20 of the tube 3 is connected to the tapping point 18. This auxiliary electrode 20 is in the shape of a loop and consists of tungsten wire approximately 0.24 mm thick. The auxiliary electrode 20 is free from the discharge tube. The spacing between the auxiliary electrode and the discharge tube is approximately a quarter of a millimeter.

In a practical embodiment the diameter of the outer bulb 1 is approximately 4.6 cm and the external diameter of the discharge tube 3 (3*a*) approximately 0.95 cm. The length of the discharge tube 3 is approximately 11.5 cm and the spacing of the main electrodes 15 and 16 is approximately 8 cm. The distance from the auxiliary electrode 20 to the main electrode 16 is approximately 27 mm. The size (0.24 mm) of the auxiliary electrode (20) in a direction parallel to the longitudinal axis of the discharge tube (3) is less than 10% of the spacing between the electrodes (3 cm.). Besides sodium and mercury the discharge tube 3 contains a starting gas consisting of neon with 0.3% argon.

The lamp described is connected in series with an inductor (not shown) of approximately 0.12 Henry to an AC mains of 220 Volts, 50 Hz. Thereafter this lamp ignites.

After starting of the lamp the values of the resistances of the voltage divider, which is indicated by reference numerals 17/19 changes from originally approximately 20 ohm/$10^5$ ohm to $2.10^5$ ohm. This is caused by the increase in temperature of the PTC resistor 17 owing to the generation of heat in the tube 3. The new voltage division implies that the potential of the auxiliary electrode 20 corresponds with approximately $\frac{1}{3}$ of the voltage difference between the main electrodes 15 and 16. The same ratio 1:3 is also found in the inside of the discharge tube at the location of electrode 20 between the main electrodes. The voltage between electrode 20 and the plasma in the tube 3 is then, however, 5 Volts at a maximum, that is to say less than 20% of the arc voltage of 105 Volts.

In the lamp described there was no evidence of attack of the wall of the discharge tube in the region electrode 20, even after it had been burning for a long time.

What is claimed is:

1. An elongated discharge lamp which comprises:
a discharge tube;
an ionizable medium in said tube;
a first main electrode disposed at one end of said tube and a second main electrode disposed at the other end of said tube; and
a starting electrode extending about a portion of the circumferential extend of said discharge tube at one axial portion thereof;
said starting electrode being connected via a first resistor to said first electrode and via a second resistor to said second main electrode;
said first resistor having a temperature dependent characteristics which is substantially more positive than said second resistor.

2. The apparatus as described in claim 1 wherein the physical dimension of the starting electrode measured along the longitudinal axis is not more than 10 percent of the spacing intermediate said first and second main electrodes.

3. The apparatus as described in claim 1 wherein the ratio of (1) the voltage difference between said first main electrode and said starting electrode and (2) the voltage difference between said starting electrode and said second main main electrode is within 20 percent of the value of the ratio between (a) the distance between said starting electrode and said first main electrode and (b) said starting electrode and said second main electrode.

4. The apparatus as described in claim 3 wherein the distance between said first main electrode and said starting electrode is greater than the distance between said starting electrode and said second main electrode.

5. The apparatus as described in claim 4 wherein said lamp is a high pressure sodium vapour discharge lamp and the wall of said discharge tube consists primarily of aluminum oxide.

6. The apparatus as described in claim 5 wherein said discharge lamp further includes an outer envelope of translucent material and wherein said first and second resistors and said starting electrode are disposed within said outer envelope.

* * * * *

UNITED STATES PATENT AND TRADEMARK OFFICE

CERTIFICATE OF CORRECTION

PATENT NO. : 4,117,371

DATED : September 26, 1978

INVENTOR(S) : JOHANNES A.J.M. VAN VLIET ET AL

It is certified that error appears in the above-identified patent and that said Letters Patent are hereby corrected as shown below:

Claim 1, line 21, Change "extend" to --extent--

Signed and Sealed this

*Fourth* Day of *December 1979*

[SEAL]

*Attest:*

SIDNEY A. DIAMOND

*Attesting Officer*

*Commissioner of Patents and Trademarks*